United States Patent [19]

Sofianek et al.

[11] Patent Number: 4,665,287

[45] Date of Patent: May 12, 1987

[54] SHIELD ASSEMBLY OF A VACUUM INTERRUPTER

[75] Inventors: Joseph C. Sofianek, Broomall; Ugo R. Tognella, Philadelphia; Richard J. Bonnett, Swarthmore, all of Pa.

[73] Assignee: General Electric Company, New York, N.Y.

[21] Appl. No.: 796,148

[22] Filed: Nov. 8, 1985

[51] Int. Cl.[4] ..... H01H 9/40

[52] U.S. Cl. ..... 200/144 B; 200/147 B

[58] Field of Search ..... 200/144 B, 144 R, 147 B

[56] References Cited

U.S. PATENT DOCUMENTS

| | | | |
|---|---|---|---|
| 2,900,476 | 8/1959 | Reece | 200/144 B |
| 3,048,681 | 8/1962 | Polinko, Jr. | 200/144 B |
| 3,048,682 | 8/1962 | Veras | 200/144 B |
| 3,586,801 | 6/1971 | Saito et al. | 200/144 B |
| 3,746,811 | 7/1973 | Saito | 200/144 B |
| 3,777,089 | 12/1973 | Nitz | 200/144 B |
| 3,996,438 | 12/1976 | Kurtz et al. | 200/144 B |
| 4,081,640 | 3/1978 | Rich | 200/144 B |
| 4,158,911 | 6/1979 | Polinko, Jr. et al. | 200/144 B X |
| 4,310,735 | 1/1982 | Sakuma et al. | 200/144 B |

*Primary Examiner*—Mark O. Budd

*Attorney, Agent, or Firm*—Walter C. Bernkopf; Richard A. Menelly; Fred Jacob

[57] ABSTRACT

A vacuum interrupter whose envelope comprises a cylindrical insulated casing and top and bottom metal end bells that support movable and fixed contact rods. The cylindrical wall portion of the end shields are secured to the cylindrical wall portion of the end bells and are positioned by snap arrangement of mating deformations, preferably protruberations and mating voids.

14 Claims, 6 Drawing Figures

SHIELD ASSEMBLY OF A VACUUM INTERRUPTER

BACKGROUND OF THE INVENTION

This invention relates to a vacuum interrupter and, more particularly, to the assembly of shield assemblies of such an interrupter.

Vacuum interrupters comprise an evacuated envelope of substantially cylindrical configuration and opposing end portions. The end portions support, respectively, a movable contact rod and a fixed contact rod. The envelope comprises insulating members, for insulating the movable and fixed contact rods, and metallic members. During operation, i.e., separation and opening of the contacts, arcing occurs that produces metal vapors. Metallic shields are therefore arranged within the envelope to prevent the metal vapors from depositing on the insulating members. Such shields are usually arranged concentrically about the common center axis of the contact rods.

In some configurations, shields are secured to metallic cylindrical wall portions of the envelope. One such arrangement is disclosed in U.S. Pat. No. 4,081,640-Rich, which is assigned to the assignee of the subject application. This illustrates metal shields secured, i.e., welded, to a metallic cylindrical wall member. Specifically, the shields have a cylindrical wall portion that is secured to the inner surface of the central cylindrical wall portion of the envelope.

Copending patent application Ser. No. (796,149)-Sofianek et al, also assigned to the same assignee, is related to the subject application and discloses a shield arrangement that incorporates the subject invention. The Sofianek application discloses an interrupter whose envelope comprises a central ceramic insulator of cylindrical configuration and metallic end members, i.e., end bells, that are substantially bell-shaped. The end bells have cylindrical wall portions. End shields also having a cylindrical wall portion are secured to the inner surface of the cylindrical wall portions of the end bells.

The shields must be properly positioned along the longitudinal axis of the interrupter. Thus, they must be accurately positioned and secured to the cylindrical wall portion of the envelope in a plane whose longitudinal position is accurately defined.

Certain methods and arrangements for positioning and securing the end shields have deficiencies. For example, the shields may be welded at prescribed positions prior to brazing of the interrupter. However, prepositioning the weld locations and welding are time consuming and costly. Further, welding the shields to the end bell generates heat that produces stresses in the end bell. These stresses could produce breaks in the seal between the end bell and the insulating casing. Alternatively, fixtures might be employed for positioning and brazing the shields. However, such fixtures can not be utilized in certain methods of interrupter assembly. Even when usable, they are undesirable. For example, in some cases, the fixtures themselves might be brazed to the interrupter components. This results in unnecessary rejects.

SUMMARY OF THE INVENTION

An object of this invention is to provide an improved arrangement for prepositioning and securing the shields of a vacuum interrupter to metallic and cylindrical wall portions of the interrupter envelope.

In accordance to the invention, the shield and the metallic wall portion of the envelope each comprise mating deformations for snap engagement of the shield member to the metallic wall portion prior to their being permanently secured to one another. Engagement is at a predetermined longitudinal position about the center axis of the envelope. Preferably, the deformations of the envelope wall portion comprise inwardly projecting protruberances. The deformations of the shield member are preferably formed on deformable tabs and preferably comprise voids, i.e., holes, that extend sufficiently to permit engagement of the shield without requiring precise axial alignment. In a preferred embodiment, cone-shaped end shields are secured as described above to end bells located on opposing sides of an insulated cylindrical casing.

BRIEF DESCRIPTION OF THE DRAWINGS

For a better understanding of the invention, reference may be had to the following detailed description taken in conjunction with the accompanying drawings, wherein.

DESCRIPTION OF THE PREFERRED EMBODIMENT

Figure 1:
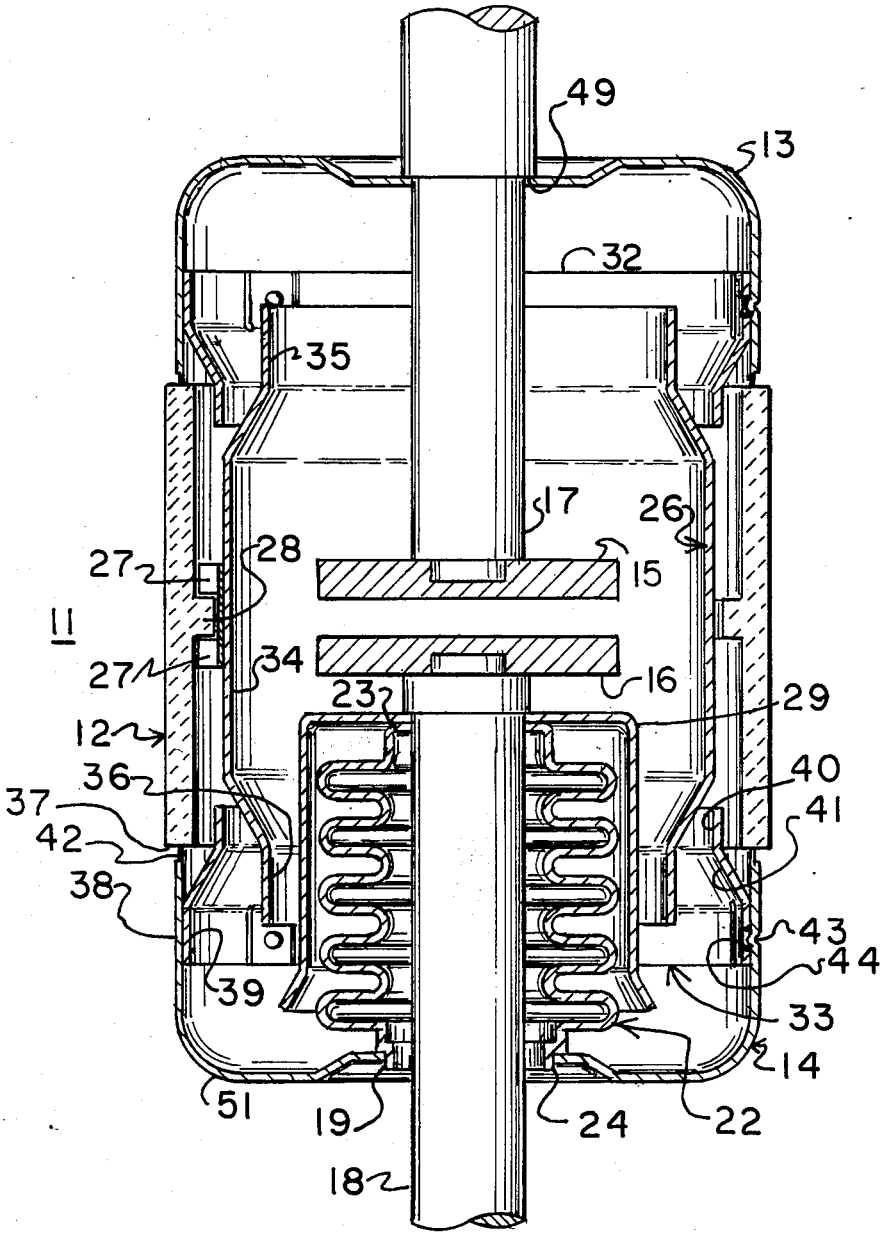
FIG. 1 is a cross sectional view of a vacuum interrupter incorporating the invention.

The invention is applicable to vacuum interrupters of the general type shown in FIG. 1. The illustrated vacuum interrupter comprises a highly evacuated envelope 11 comprising a tubular casing 12 of electrical insulating material and two metal end bells 13 and 14. Located within the envelope are two relatively movable contacts 15 and 16.

Contact 15 is a stationary contact carried by stationary contact rod 17 which extends in sealed relationship through the upper end bell 13. Contact 16 is a movable contact carried by movable contact rod 18 which extends freely through a central opening 19 in the lower end bell 14.

A flexible metal bellows 22 provides a seal about the movable contact rod 18. Bellows 22 has its upper end 23 joined to the movable contact rod 18 and its lower end 24 joined to the periphery of the lower end bell that defines the central opening 19.

The interrupter is shown in its open position, i.e., with its contacts 15 and 16 displaced from one another. Closure is effected by driving the movable contact rod 18 upward so as to engage the contacts. Opening, i.e., circuit interruption, results from lowering the movable contact rod 18 to the illustrated position.

Contact opening, i.e., separation, establishes an arc between the contacts which generally persists approximately until a natural current zero is reached. At such time, interruption is completed. The arcing produces metal vapors that deposit on surrounding surfaces.

A bellows shield 29 is provided to protect bellows 22 from the metal vapors.

It is obviously essential to prevent metal vapor deposition on the insulated casing 12. A tubular metal main shield 26 provides primary protection against such deposition. Main shield 26 is concentrically secured to the inner periphery of insulating casing 12. This may, for example, be done with metal clips 27 that are secured, e.g., by spot welding, at points equidistant about the outer periphery of shield 26 and at its longitudinal center. Clips 27 engage protrusions 28 extending inwardly from casing 12.

Insulated casing 12 is further protected from metal vapor deposition by end shields 32 and 33. Upper metal end shield 32 and lower metal end shield 33 are secured, respectively, to upper and lower end bells 13 and 14 and extend concentrically between insulated casing 12 and main shield 26. Thus, metal vapors escaping from the ends of the main shield 26 are prevented by end shields 32 and 33 from reaching the insulated casing 12.

Figure 2A:
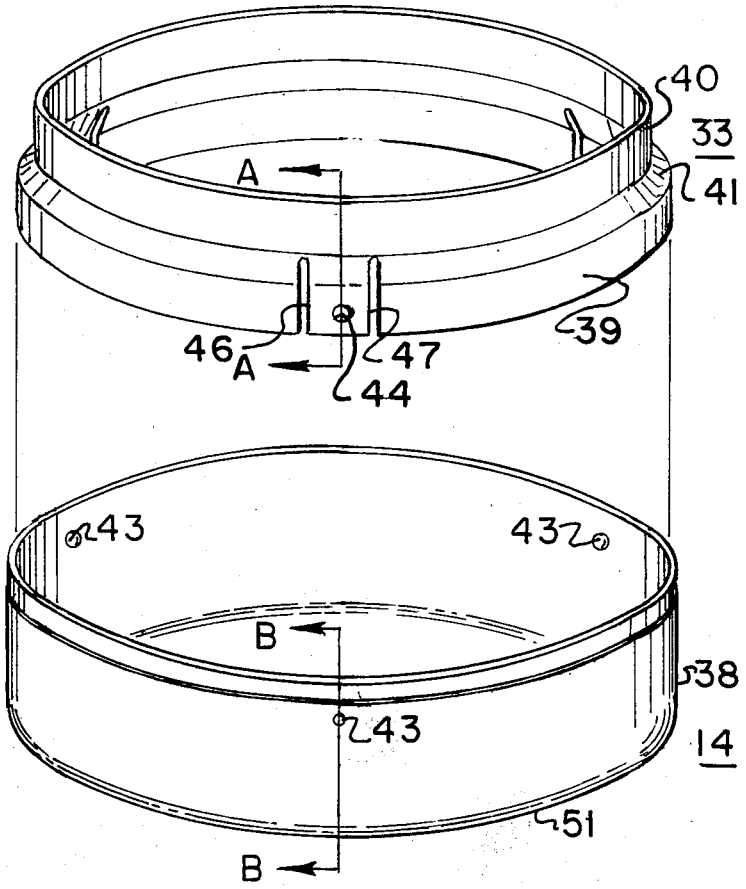
FIG. 2A is an exploded view of an end bell and of an end shield of the interrupter illustrated in FIG. 1.
Figure 2B:
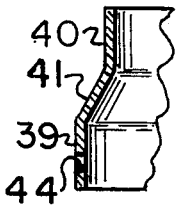
FIG. 2B is a cross section of the end shield taken on the A—A of FIG. 2A.
Figure 2C:
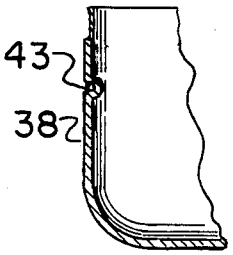
FIG. 2C is a cross section of the end bell taken on the plane B—B of FIG. 2A.

Further reference is now made to the configuration, illustrated in FIG. 1, of the end bells, end shields, insulated casing and main shield. For purposes of this discussion, the upper and lower components have a substantially symmetrical and similar configuration. Thus, reference is only made to the lower end bell and the lower end shield and to their relationships with the insulated casing and main shield. FIG. 2A shows an exploded view of the end bell and end shield.

The lower end shield 33 is a cone-like structure comprising a first annular wall portion 39 and a second annular wall portion 40. The second portion 40 has a diameter smaller than that of the first portion 39 and these two portions are joined by a sloping central portion 41.

End shield 33 is secured to the interior of end bell 14 and extends inwardly toward the longitudinal center of the interrupter. End bell 14 is substantially bell or cup-shaped and comprises a dome-shaped end portion 51 with central opening 19 and a contiguous cylindrical wall portion 38. The open end of wall portion 38 is secured to the lower end of insulated casing 12. Specifically, the lip end 42 of wall portion 38 is secured, i.e., brazed, to the end surface 37 of casing 12. Annular wall portion 39 of end shield 33 has a diameter selected so that it abuts, and is secured to, the interior of wall portion 38 of the end bell. The top end bell 13 has a configuration similar to that of bottom end bell 14 except for its central opening which surrounds fixed contact arm 17 at shoulder 49.

The main shield 26 has a central cylindrical portion 34 which slopes at opposing ends into an upper cylindrical end portion 35 and into lower cylindrical end portion 36. The diameter of portions 35 and 36 is smaller than that of the central portion 34.

The second annular wall portion 40 of the end shield extends into the annular space between the insulated casing 12 and the cylindrical end portion 36 of the main shield. The end shield should extend an appropriate and specified distance over the insulated casing 12. Thus, the end shield must be secured to cylindrical wall portion 38 of the end bell in a plane whose longitudinal location is accurately defined. The end shield must thus be accurately positioned with respect to the end bell prior to brazing and it must be retained in the appropriate position until brazing is completed.

In accordance to the invention, the end shields are positioned with respect to the end bells without reliance on auxiliary devices, such as jigs and fixtures, and without reliance on gravitational force and thus without the requirement to assemble the components while arranged in a predetermined position. For this purpose, the end bells and end shields are provided with deformations permitting snap engagement and retention of the end shields to the end bells. Deformations are provided on the interior of cylindrical wall portion 38 of the end bells. Mating deformations are provided on the first annular wall portion 39 of the end shields. In the preferred embodiment, the deformations of the end bell comprise a plurality of inwardly extending protrusions 43. These are displaced substantially equidistant from one another in a plane that is orthogonal to the central axis of the end bell and, subsequent to assembly, orthogonal to the longitudinal axis of the interrupter. In the preferred embodiment, three protrusions or dimples 43 are displaced 120° apart. Voids 44 are displaced on annular wall portion 39 in a plane orthogonal to the central axis of the end shields and oriented to mate with protrusions 43. In the preferred embodiment, protrusions 43 are embossed during manufacture of the end bell. In one embodiment, a 0.06 inch thick wall portion 39 has an embossment of 0.05 inch radius extending about 0.03 inch from its wall surface. Voids 44 are preferably made during manufacture of the end shields and comprise, in this embodiment, holes of 0.12 inch diameter.

Figure 4:
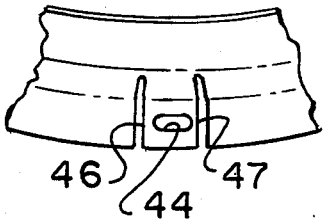
FIG. 4 is an alternative embodiment of a mating deformation, i.e., void, on the end shield of the interrupter.

FIG. 4 illustrates an alternative and preferred configuration of the voids. Voids 44 are peripherally extended in the direction of the aforementioned plane. This permits greater peripheral tolerance so that the protruberances need not be located as precisely as required when the matching pairs are both of a basically hemispherical shape.

The end shield is partially slotted alongside the void so that a light spring force can be exerted between the protrusions and the voids without distorting the end bell. Distortion of the end bell must be avoided since it will reduce the flatness of the end surface, i.e., lip end 42, of the end bells resulting in excessive clearance at the mating surface between the end bell and the insulating casing 12. Gap clearances exceeding a few thousandths of an inch will prevent the braze material from bridging the gap. As shown in FIGS. 2A and 4, parallel slots 46 and 47 are cut on opposite sides of each void 44. These slots extend through annular wall portion 39 of the end shield.

Figure 3:
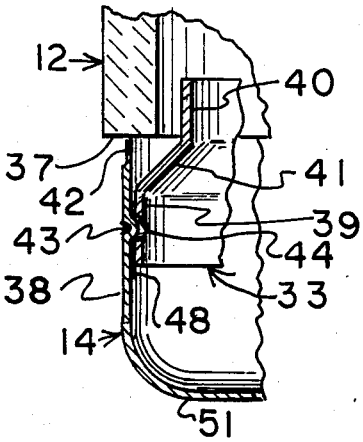
FIG. 3 is a cross sectional view of the end bell, end shield and insulated casing of the interrupter of FIG. 1.

The end shield must be permanently secured, i.e., brazed, to the end bell during assembly of the interrupter. For this purpose, a braze alloy is provided intermediate the end bell and end shield at points adjacent to the mating deformations 43 and 44. For example, braze shims 48, as shown in FIG. 3, may be spot welded to the inner periphery of cylindrical wall portion 38. Welding these small shims does not generate enough heat to unduly stress the end bell. Alternatively, braze wires may be inserted between the wall portions 38 and 39 such that gravitational flow of the braze alloy secures these wall portions in the vicinity of the mating deformations. In the orientation illustrated in FIG. 3, braze wires could be inserted between wall portions 38 and 39 above protruberance 43.

The vacuum interrupter may be assembled and brazed in a conventional manner. For example, the components of the stationary end and the components of the movable, i.e., operating, end may be separately assembled with suitable braze rings and shims. However, during assembly, the end shield 32 is snap inserted into end bell 13 so that protrusions, or dimples, 43 engage with the respective voids, i.e., holes, 44. Prior to insertion, the slotted tabs containing voids 44 are, if necessary, adjusted to assure a proper snap fit. The stationary and movable assemblies may then be separately brazed. The mainshield 26 can be inserted into casing 12 and can be retained thereto by clips, i.e., tabs, 27. Finally, the stationary and movable operating assemblies may be secured to insulated casing 12. For this purpose, suitable brazing rings are interposed between lip end 42 of each end bell and the corresponding annular end surface 37 of the insulated casing, and the interrupter assembly is brazed and evacuated.

Although a particular embodiment of the invention has been disclosed, it will be obvious to those skilled in the art that various changes and modifications may be made without departing from the invention in its broader aspects. It is therefore intended to cover all such changes and modifications as fall within the tone, spirit and scope of the invention.

What we claim as new and desire to secure by Letters Patent is:

1. A vacuum type circuit interrupter comprising:

(a) a cylindrical insulated casing and first and second end bells joined thereto on opposing sides in a sealed relationship;

(b) a movable contact rod, supporting a movable contact, and a fixed contact rod supporting a fixed contact extending through said first and second end bells, respectively;

(c) a main insulating shield concentrically secured within the insulated casing so as to surround the movable and fixed contacts;

(d) first and second end shields secured to and extending concentrically within said first and second end bells, respectively;

(e) said end bells and said end shields each comprising first cylindrical wall portions dimensioned to be substantially contiguous to one another; and (f) the first cylindrical wall portions of said end bells and of said end shields each comprising mating deformations in a plane substantially orthogonal to their central axis and configured for snap engagement of the end shields to said end bells so that said end shields are properly positioned about the longitudinal axis of the interrupter.

2. The vacuum interrupter of claim 1 wherein the mating deformations on the cylindrical wall portion of the end shields are discretely displaced from one another and are on notched tabs to minimize distortion of the end bells upon snap engagement of the end shields to the end bells.

3. The vacuum interrupter of claim 1 or claim 2 wherein the mating deformations of the end bells comprise discrete inwardly extending protruberances.

4. The vacuum interrupter of claim 3 wherein the mating deformations of the end shields comprise discrete deformations, each extending in a plane substantially orthogonal to the central axis of the end shields to provide for snap engagement with the protruberances without requiring precise axial orientation.

5. The vacuum interrupter of claim 3 wherein the mating deformations in the end shields comprise a plurality of apertures.

6. The vacuum interrupter of claim 5 wherein the apertures are substantially equidistant from one another.

7. The vacuum interrupter of claim 6 wherein the apertures are extended to provide for snap engagement of the protruberances of the end walls without requiring precise axial orientation.

8. A vacuum type circuit interrupter comprising:

(a) an evacuated envelope comprising a cylindrical insulated casing and an end bell joined thereto in sealed relationship;

(b) said end bell being substantially cup-shaped and comprising a central opening;

(c) a contact rod extending through said central opening;

(d) a substantially cone-shaped end shield configured to be secured to and extending concentrically within said end bell;

(e) said end bell and end shield each comprising cylindrical wall portions dimensioned to be substantially contiguous to one another;

(f) the cylindrical wall portion of said end bell comprising a plurality of inwardly extending protruberances;

(g) the cylindrical wall portion of said end shield comprising a plurality of apertures positioned with respect to said protruberances for snap engagement of the end shield to the end bell in a predetermined longitudinal position about the center axis of the interrupter.

9. The vacuum interrupter of claim 8 wherein the cylindrical wall portion of the end shield is notched on opposing sides of the apertures to minimize distortion of the end bell upon snap engagement of the end shield to the end bell.

10. The vacuum interrupter of claim 9 wherein the apertures are extended with respect to the protruberances to provide snap engagement without precise axial orientation between the end shield and the end bell.

11. A vacuum type circuit breaker having an evacuated envelope of substantially cylindrical configuration and opposing end portions supporting, respectively, a movable contact rod and a fixed contact rod extending coaxially with the center axis of the envelope, comprising:

(a) said envelope having at least one metallic wall portion of cylindrical configuration;

(b) at least one metallic shield member formed to be concentrically positioned intermediate said metallic wall portion and at least one of said movable contact rod and of said fixed contact rod;

(c) said metallic shield member having a cylindrical wall portion dimensioned to fit substantially contiguously within the metallic wall portion of the envelope;

(d) the cylindrical wall portion of the shield member and the metallic wall portion of the envelope each comprising mating deformations configured for snap engagement of the shield member to the metallic wall portion at a predetermined longitudinal position about the center axis of the envelope;

(e) the cylindrical wall portion of said shield member being permanently secured, such as by brazing, to the metallic wall portion.

12. The vacuum interrupter of claim 11 wherein the mating deformations on the cylindrical wall portion of said shield member are discretely displaced from one another and are on notched tabs to minimize distortion of the metallic wall portion upon snap engagement of the shield member.

13. The vacuum interrupter of claims 11 or 12 wherein the mating deformations of the metallic wall portion comprise discrete inwardly extending protruberances.

14. The vacuum interrupter of claim 13 wherein the mating deformations of the cylindrical wall portion of the shield member comprise discrete voids, each extending in the plane substantially orthogonal to the center axis of the interrupter to provide for snap engagement with the protruberances without requiring precise circumferential alignment.

* * * * *